United States Patent [19]

Netsky

[11] Patent Number: 4,547,907

[45] Date of Patent: Oct. 22, 1985

[54] PATIENT'S GOWN

[76] Inventor: Margaret Netsky, 1405 Chickering Rd., Nashville, Tenn. 37215

[21] Appl. No.: 477,351

[22] Filed: Mar. 21, 1983

[51] Int. Cl.[4] ..... A41B 9/00

[52] U.S. Cl. ..... 2/114; 2/243 R; 2/DIG. 7; 2/243 B

[58] Field of Search ..... 2/114, DIG. 7, 243 R, 2/243 B, 74

[56] References Cited

U.S. PATENT DOCUMENTS

| | | | |
|---|---|---|---|
| 2,173,344 | 9/1939 | Spanel | 2/74 |
| 3,078,467 | 2/1963 | Artzt | 2/114 |
| 3,276,036 | 10/1966 | Cater | 2/114 |

*Primary Examiner*—Doris L. Troutman

*Attorney, Agent, or Firm*—Watson, Cole, Grindle & Watson

[57] ABSTRACT

A gown for use by a patient in a medical facility is made from a single pattern composed of a single, homogeneous piece of pliable material which is configured to provide an elongated main portion and two generally rectangularly shaped projection portions respectively extending away from the opposite sides thereof, an opening forming a collar, and a slit extending between the collar and an intersection point where one side of a first of the two projection portions intersects with the side of the main portion, the pattern then being modified to include no more than three fastening devices, one being located where the slit connects with the collar and another being located where the slit connects with the intersection point, the modified pattern then being folded about a transverse center line to provide a gown form and two associated side portions of the main portion and the associated sides of one of the two projection portions are permanently connected along the lengths.

10 Claims, 5 Drawing Figures

PATIENT'S GOWN

BACKGROUND OF THE INVENTION

1. Field of the Invention

The present invention is directed to garments in the form of gowns which are worn by patients in medical facilities, and more particularly to such gowns which are light in weight, comfortable to wear, easy to put on and take off, and which provide for easy access to the torsos of the patients wearing the gowns, i.e., for examinations and for carrying out various treatments such as the connection to the patients of the necessary external medical equipment.

2. The Prior Art

Light-weight gowns for use by patients in hospitals, nursing homes, medical clinics, doctors' offices, etc., are well known. These gowns, which are often made of cotton, are comfortable to wear and easy to put on and take off.

For example, in U.S. Pat. No. 3,276,036 to Cater a gown for use by a patient in a hospital is disclosed which is light in weight, comfortable to wear, easy to put on and take off, and which provides a certain degree of access to the torso of the person wearing the gown. This gown, which is openable along one side, is made by connecting together, e.g. by stitching, three separately prepared pieces of material (e.g. cotton). These material pieces, called blanks, include a configured blank which forms the front and rear body portions of the ultimately produced gown, and two generally triangularly shaped blanks which form the opposite right and left sleeves of the gown. A multiplicity of fasteners, i.e., snap fasteners or ties, are attached to the interconnected blanks at various locations along their sides which provide the side opening for the gown so as to enable the gown to be closed once put on by the wearer.

Although the gown disclosed in Cater provides certain advantageous features, because it is constructed from three separately configured blanks and because it clearly requires the use of so many fasteners (at least nine), it is somewhat time consuming to construct and thus more expensive to produce than is desirable, and it is not entirely easy to put on and take off. In addition, it does not provide sufficiently quick access to the torso of the wearer in an emergency, i.e., if all the fasteners thereon are connected, as is optimally desirable.

Thus, it is an object of the present invention to provide a gown which can be worn by a patient in a medical facility and which will not only suitably cover the wearer, but which will be light in weight, comfortable to wear, easy to put on and take off, and which will be constructed to provide for exceptionally quick and easy access to the torso of the wearer by medical personnel.

It is a further object of the present invention to provide such a gown which is both simple and inexpensive to make.

It is a further object of the present invention to provide such a gown which is reversible.

It is a still further object of the present invention to provide a method for making such a gown.

SUMMARY OF THE PRESENT INVENTION

According to the present invention, a gown which satisfies all of the foregoing objects can be made by suitably modifying a single pattern consisting of a homogeneous piece of pliable material, this material being suitably fabricated (e.g. cut) from a homogeneous sheet of the pliable material, such that after no more than three fastening means have been attached thereto, the pliable material can be folded along a transverse center line to provide a gown form, and the gown form can be connected (e.g. stitched) along one side so as to form the gown. Because the gown is made from only a single pattern consisting of a homogeneous piece of pliable material and will utilize no more than three fastening means which are located at at least two critical points along the side of the gown, one of the fastening means including a closure loop, the gown will be very easy and inexpensive to make and will provide exceptionally quick and easy access to the torso of the person wearing the gown.

A more complete understanding of the present invention will be achieved by reference to the attached drawings, taken in conjunction with the following discussion.

DETAILED DESCRIPTION OF THE PREFERRED EMBODIMENTS

Figure 1:
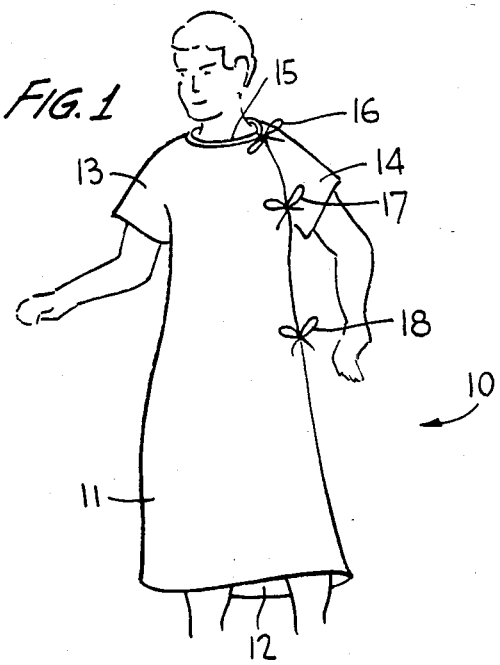
FIG. 1 is a front elevational view of a gown constructed in accordance with one embodiment of the present invention, the gown being shown worn by an adult male.

One embodiment of a gown according to the present invention is shown in FIG. 1, the gown being sufficiently large that it can be worn by an adult (as indicated). The gown, generally labeled as 10, includes a front body part 11, a rear body part 12, a right sleeve part 13 and a left sleeve part 14. The sides of the front and rear body parts 11 and 12 below right sleeve part 13 are connected as are the lower sides of the right sleeve part 13, whereas the sides below the left sleeve part 14 are not, thus providing part of the opening along the left side of the gown which allows the gown to be put on by the wearer. The remainder of the opening is provided by a slit which extends from a point below the left sleeve part 14 (i.e., at the underarm) to the collar 15, which is formed by an opening between the sleeve parts 13 and 14. Three fastening means 16, 17 and 18 are located along the side opening of the gown, the fastening means 16 being located at the collar 15, the fastening means 17 being located along the side of the gown just below the left sleeve part 14 (i.e., at the underarm), and the fastening means 18 being located along the side of the gown between the fastening means 17 and the bottom of the gown, preferably at a point expected to be coincident with the waistline of the person wearing the gown. The various elements which make up the fastening means 16, 17 and 18 will be discussed in greater detail below.

Figure 2:
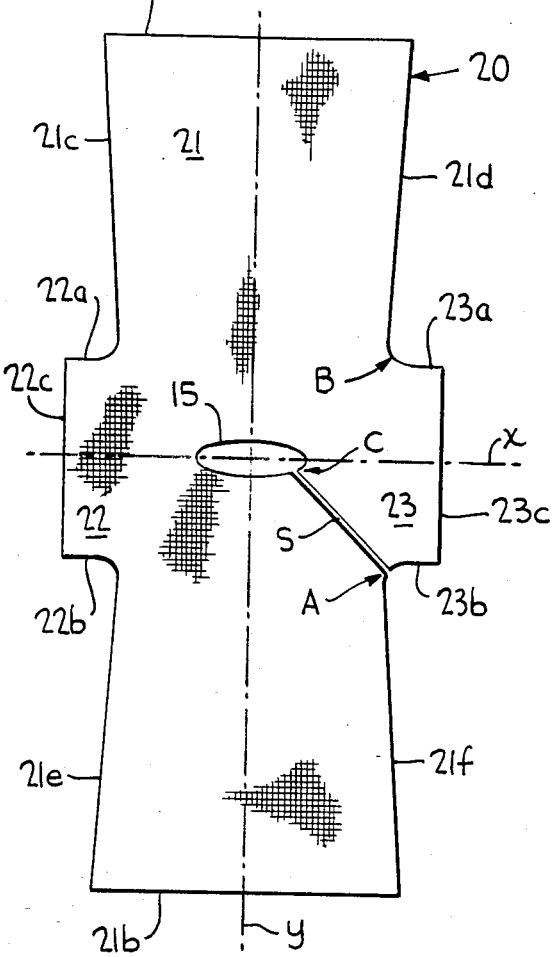
FIG. 2 is a plan view of a pattern which can be used to make the gown in FIG. 1.

FIG. 2 shows a single pattern which can be used to make the gown in FIG. 1. The pattern is composed of a single homogeneous piece of pliable material 20, e.g., a textile fabric such as cotton or polyester, or a suitable plastic material, which is itself fabricated (e.g. cut) from a homogeneous sheet of the pliable material (not shown), to form an elongated main portion 21 and projection portions 22 and 23 which respectively extend away from the opposite sides of the main portion 21. The main portion 21, which is substantially symmetrical about both a transverse center line X and a longitudinal center line Y, includes opposite ends 21*a* and 21*b* which are generally straight and parallel and opposite side portions 21*c*, 21*d*, 21*e* and 21*f* which converge to some extent towards one another as they extend inwardly from the ends 21*a* and 21*b*. The projection portions 22 and 23, which are generally rectangular in shape and are located so as to be essentially symmetrical about the transverse center line X, include opposite sides 22*a*, 22*b*, 23*a*, 23*b* and ends 22*c*, 23*c*. The points where the sides 23*a* and 23*b* intersect with the side portions 21*d* and 21*f* of the main portion 21 are shown as intersection points A and B.

The main portion 21 of the material 20 includes an elliptical opening at its center, the longitudinal center line of the elliptical opening being coincident with the transverse center line X, so as to form a collar 15, as well as slit S which extends from the elliptical opening (see intersection point C at collar 15) to intersection point A.

Figure 3:
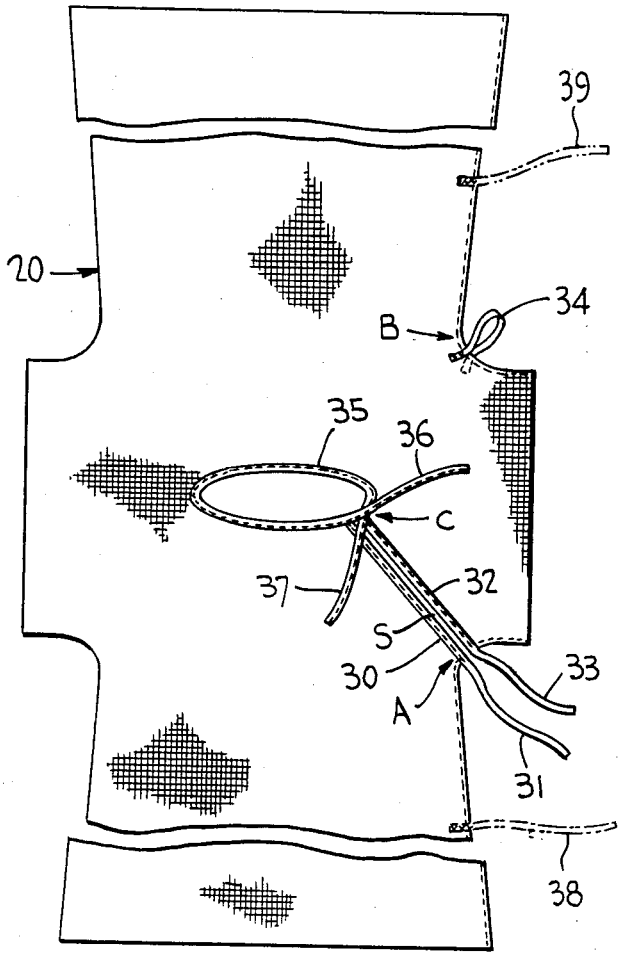
FIG. 3 is a plan view of the pattern of FIG. 2, shown on an enlarged scale and with certain parts broken away, which has been modified to include a closure loop and closure ties which are part of the gown in FIG. 1, and FIGS. 4 and 5 are front and side elevational views of a gown constructed in accordance with a second embodiment of the present invention, the gown being shown worn by an infant.

FIG. 3 shows the pattern of FIG. 2 after it has been modified to include the elements of the fastening means 16, 17 and 18. More specifically, strips 30 and 32 have been attached (e.g. stitched) along the sides of the material 20 which define the slit S, each of these strips being sufficiently long that their ends provide closure ties 31 and 33 at intersection point A, these ties helping to provide the elements of fastening means 17. A closure loop 34 has been attached (e.g. stitched) to the material 20 at intersection point B to provide the other element of fastening means 17. In addition, a strip 35 has been attached (e.g. stitched) to the material 20 at the collar 15 (note: it does not extend across the slit S), the strip 35 being sufficiently long that its ends provide closure ties 36 and 37 at intersection point C, these ties providing the elements of the fastening means 16 on the gown 10 in FIG. 1. Finally closure ties 38 and 39 have been attached (e.g. stitched) to the material 20 at suitable corresponding points along side portions 21*d* and 21*f*, these closures ties providing fastening means 18.

The gown shown in FIG. 1 is thereafter made from the modified pattern shown in FIG. 3 by folding the material 20 about its transverse center line X to provide a gown form, and then continuously connecting (e.g. stitching) the side portion 21*c* of the main portion 21 to the side portion 21*e* and the side 22*a* of the projection portion 22 to the side 22*b* (thus forming the right sleeve part 13 as shown in FIG. 1) as a flat-fell seam. In addition, in order to protect the gown from tearing, all the remaining ends and sides of the material 20 can be hemmed or reinforced in some similar fashion.

With respect to the foregoing, the folded main portion 21 will provide the front and rear body parts 11 and 12 as shown in FIG. 1, the projection portion 22 will form the right sleeve part 13 and the projection portion 23 will form the left sleeve part 14. The closure ties 31 and 33, as well as the closure loop 34, will be located just below the left sleeve part 14.

Figure 4:
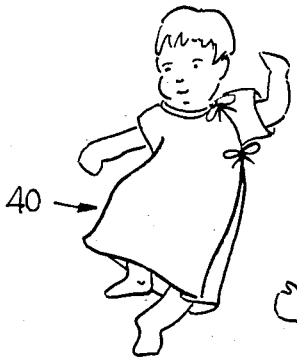
Figure 5:
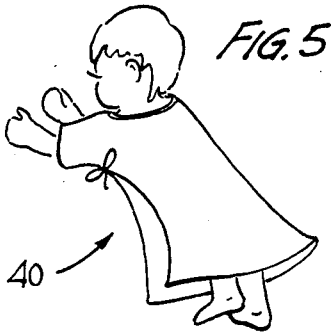

Referring now to FIGS. 4 and 5, a second embodiment of gown 40 according to the present invention is shown which is much smaller in size than the one shown in FIG. 1 and is adaptable to be worn by an infant (as indicated). The shape of the pattern used to form this gown embodiment will be identical to that shown in FIG. 2 (although much smaller in size) and the pattern will be similarly modified to the condition shown in FIG. 3, except that the closure ties 38 and 39 (i.e. fastening means 18) will be omitted since the side of the gown 40 will be so short in length that this additional fastening means will be unnecessary. Thereafter the modified pattern will be folded to form the gown form as noted above and finally connected along its right side to form the gown 40.

With either embodiment of the gown according to the invention, the wearer will put the gown on by extending his or her right arm through the right sleeve part 13 and then place the left sleeve part 14 over his or her left shoulder, after which he or she (or an attendant) will (1) tie together the closure ties 36 and 37, (2) extend the closure tie 31 upwardly through the loop 34 and tie it to the closure tie 33 (or alternately extend the closure tie 33 downwardly through the loop 34 and tie it to the closure tie 31), and, if present, (3) tie together the closure ties 38 and 39.

It will be clear that various changes in the gown embodiments described could be made and still provide a product which would fall within the scope of the appended claims.

I claim:

1. A light weight gown for use by a patient in a medical facility and which is comfortable to wear, easy to put on and take off, simple and inexpensive to make, and which allows for quick and easy access to the patient by medical personnel, said gown being openable along one side, said gown being made by the steps of (1) providing a single pattern made from a single, homogeneous piece of textile fabric which is configured to include (a) an elongated main portion which has opposite ends that are generally straight and parallel and opposite side portions which converge to some extent towards one another as they extend inwardly from the ends of said main portion, said main portion being substantially symmetrical about both a transverse center line and a longitudinal center line passing therethrough, (b) first and second generally rectangularly shaped projection portions respectively extending away from the opposite sides of said main portion so as to be substantially symmetrical about said transverse center line, the point where one side of said first projection portion intersects with the associated side of said main portion being called intersection point A and the point where the opposite side of said first projection portion intersects with the associated side of said main portion being called intersection point B, (c) an opening at the center of said main portion, and (d) a slit extending from said opening to intersection point A, the point where said slit communicates with said opening being called intersection point C, (2) attaching first and second closure ties to said textile fabric so as to respectively be connected to the opposite edges thereof which define said slit at intersection point A, (3) attaching a closure loop to said textile fabric so as to extend away therefrom at intersection point B, (4) attaching third and fourth closure loop ties to said textile fabric so as to respectively be connected to the opposite edges thereof which define said slit at intersection point C, (5) folding said textile fabric about said transverse center line so as to provide a gown form having a front body part, a rear body part, right and left sleeve parts, a neck opening, a slit extending from the neck opening to a point at the underarm below one of said right and left sleeve parts, a closure loop attached to the side of the rear body part below said one sleeve part, and closure ties connecting the edges of the textile fabric defining the slit at the neck opening and at a point below said one sleeve part, as well as to connect said rear body part to said front body part at a point below said one sleeve part, and (6) connecting the side of said front body part to the associated side of said rear body part along their lengths below the second of said right and left sleeve parts of said gown form and the associated opposite sides of the projection portion which provides the second of said right and left sleeve parts so as to provide said gown.

2. The light weight gown as defined in claim 1 wherein said textile fabric is cotton.

3. The light weight gown as defined in claim 1 wherein said textile fabric is a polyester fabric.

4. The light weight gown as defined in claim 1 wherein in step (2) two flexible strips are respectively attached to the opposite edges of said pliable material which define said slit, said flexible strips being sufficiently long that respective ends thereof provide said first and second closure ties.

5. The light weight gown as defined in claim 1 wherein in step (4) a flexible strip is attached to said textile fabric around said opening so as to form a reinforced collar, said flexible strip being sufficiently long that its opposite ends provide said third and fourth closure ties.

6. The light weight gown as defined in claim 1 including prior to step (5) the step of attaching fifth and sixth closure ties to the side of said main portion which includes intersection points A and B and at respective, corresponding points between intersection points A and B and the respective ends of said main portion.

7. The light weight gown as defined in claim 1 wherein said opening at the center of said main portion is elliptical, the longitudinal axis of said elliptical opening being coincident with said transverse center line.

8. A method of making a light weight gown for use by a patient in a medical facility and which is comfortable to wear, easy to put on and take off, simple and inexpensive to make, and which allows for quick and easy access to the patient by medical personnel, said gown being openable along one side, said gown being made by the steps of (1) providing a single pattern from a single, homogeneous piece of textile fabric so as to be configured to include (a) an elongated main portion which has opposite ends that are generally straight and parallel and opposite side portions which converge to some extent towards one another as they extend inwardly from the ends of said main portion, said main portion being substantially symmetrical about both a transverse center line and a longitudinal center line passing therethrough, (b) first and second generally rectangularly shaped projection portions respectively extending away from the opposite sides of said main portion so as to be substantially symmetrical about said transverse center line, the point where one side of said first projection portion intersects with the associated side of said main portion being called intersection point A and the point where the opposite side of said first projection portion intersects with the associated side of said main portion being called intersection point B, (c) an opening at the center of said main portion, and (d) a slit extending from said opening to intersection point A, the point where said slit communicates with said opening being called intersection point C, (2) attaching first and second closure ties to said textile fabric so as to respectively be connected to the opposite edges thereof which define said slit at intersection point A, (3) attaching a closure loop to said textile fabric so as to extend away therefrom at intersection point B, (4) attaching third and fourth closure loop ties to said textile fabric so as to respectively be connected to the opposite edges thereof which define said slit at intersection point C, (5) folding said textile fabric about said transverse center line so as to provide a gown form having a front body part, a rear body part, right and left sleeve parts, a neck opening, a slit extending from the neck opening to a point at the underarm below one of said right and left sleeve parts, a closure loop attached to the side of the rear body part below said one sleeve part, and closure ties connecting the edges of the textile fabric defining the slit at the neck opening and at a point below said one sleeve part, as well as to connect said rear body part of said front body part at a point below said one sleeve part, and (6) connecting the side of said front body part to the associated side of said rear body part along their lengths below the second of said right and left sleeve parts of said gown form and the associated opposite sides of the projection portion which provides the second of said right and left sleeve parts so as to provide said gown.

9. The method as defined in claim 8 wherein in step (a) the pattern is cut from a homogeneous sheet of said textile fabric.

10. A pattern for use in making a light weight gown for use by a patient in a medical facility which comprises a single, homogeneous piece of textile fabric which is configured to include (a) an elongated main portion which has opposite ends that are generally straight and parallel and opposite side portions which converge to some extent towards one another as they extend inwardly from the ends of said main portion, said main portion being substantially symmetrical about both a transverse center line and a longitudinal center line passing therethrough, (b) first and second generally rectangularly shaped projection portions respectively extending away from the opposite sides of said main portion so as to be substantially symmetrical about said transverse center line, the point where one side of said first projection portion intersects with the associated side of said main portion being called intersection point A, (c) an opening at the center of said main portion, and (d) a slit extending from said opening to intersection point A.

* * * * *